United States Patent [19]

Bohrn et al.

[11] 4,445,243

[45] May 1, 1984

[54] PARTICLE INK APPLICATION

[75] Inventors: Walter J. Bohrn; Peter J. Sydorko, both of Lancaster, Pa.

[73] Assignee: Armstrong World Industries, Inc., Lancaster, Pa.

[21] Appl. No.: 401,922

[22] Filed: Jul. 26, 1982

[51] Int. Cl.[3] ..... D06B 1/06

[52] U.S. Cl. ..... 8/151; 8/158; 68/205 R; 118/324; 118/602

[58] Field of Search ..... 8/151, 158; 68/205 R; 118/602, 612, 324, 325

[56] References Cited

U.S. PATENT DOCUMENTS

| | | | |
|---|---|---|---|
| 2,111,761 | 3/1938 | Eckert | 118/602 X |
| 3,964,860 | 6/1976 | Leifeld | 68/205 R X |
| 4,198,836 | 4/1980 | Goodson | 68/205 R |
| 4,369,640 | 1/1983 | Fox | 68/205 R |
| 4,375,158 | 3/1983 | Eichmanns et al. | 68/205 R |

FOREIGN PATENT DOCUMENTS

| | | | |
|---|---|---|---|
| 1288681 | 9/1972 | United Kingdom | 68/205 R |

*Primary Examiner*—Philip R. Coe

[57] ABSTRACT

Dye for coloring a carpet is applied to a manifold and then passed through a plurality of nozzles to a plate. The dye floods across the plate and then falls off the edge of the plate in a waterfall-like pattern to a carpet being carried below the plate. This provides for a coloring of the carpet with the dye. The improvement herein is in the recirculation of the dye in the manifold to maintain the particles in the dye in suspension, and further, to interrupt the flow of dye from the nozzles to the plate to better distribute dye particles on the plate for subsequent distribution to the carpet.

5 Claims, 1 Drawing Figure

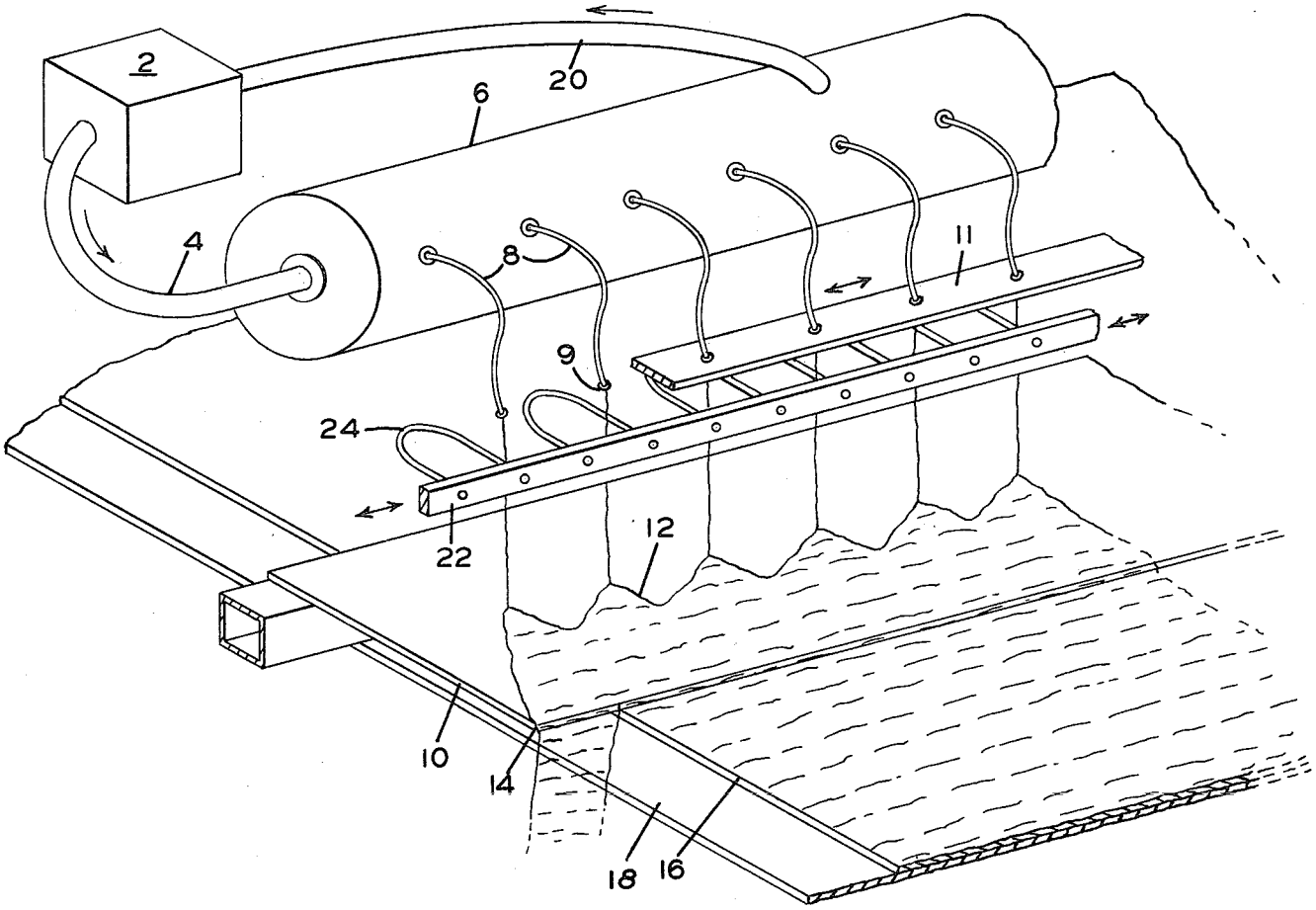
2
4
6
8
9
10
11
12
14
16
18
20
22
24

PARTICLE INK APPLICATION

BACKGROUND OF THE INVENTION

1. Field of the Invention

The invention is directed to a method of applying a dye to a carpet and, more particularly, to a technique for keeping the particles in the dye in suspension to prevent streaking of concentrated dye particles on the carpet.

2. Description of the Prior Art

U.S. Pat. No. 3,731,503 is directed to a device and method for applying dye to a fabric. An oscillatory wiper blade channels dye into streams and the streams are divided by a moving wire member into a discontinuous pattern.

U.S. Pat. No. 3,683,649 is directed to an apparatus for continuously dyeing carpet. A mechanical means will effect dispersions of jets of dye into individual dye liquid droplets.

There is available conventionally on the market a dye applicator which uses a dye not containing coloring particles. The dye is fed to a manifold and from the manifold it flows through 288 nozzles out onto a flat plate. The flat plate then delivers the dye to the carpet. Any variation in dye coloration from one nozzle to the next is transmitted to the carpet in the form of a dye streak.

SUMMARY OF THE INVENTION

A method is provided for applying dye to a carpet. The dye is supplied from a supply tank to a manifold and is distributed from the manifold through a plurality of nozzles. The dye moving from the nozzles is agitated to break up its flow path so that the dye falls non-uniformly on a plate means. The dye then flows off the plate means onto the carpet. A means is provided to maintain agitation of the dye in the manifold to keep the coloring particles uniformly distributed within the dye.

BRIEF DESCRIPTION OF THE DRAWING

The drawing is a schematic showing of the apparatus carrying out the invention herein.

DESCRIPTION OF THE PREFERRED EMBODIMENT

Carpet is normally dyed through the use of a dye containing coloring particles suspended within the dye liquid. The coloring particles within the dye is in suspension within the dye liquid and can settle into concentrated distributions within the liquid.

Normally the dye is kept in a supply tank 2 and by appropriate hosing with either pump or gravity flow carried by the hosing 4 to a manifold 6. The dye then moves out of the manifold 6 through a plurality of nozzle assemblies or nozzle tubes 8. In a typical machine, there may be 288 nozzles extending across the 12' width of the carpet. The dye comes out of the nozzle 9 as a stream of liquid. The stream of liquid would normally then fall on an inclined flood plane plate 10 and would spread out across the plate 10 as shown by the dye distribution pattern 12. It would then flow off the end 14 of the plate in a waterfall-like manner so that it then drops upon the carpet 16 which is carried on an appropriate conveyor structure 18 below the flat plate. In effect one is forming a curtain of dye liquid which the carpet then flows under and picks up the dye liquid for the coloring of the carpet.

It has been found that with this apparatus there tends to be some concentration of dye particles in different parts of the apparatus so that the dye coming out of one nozzle could be lighter and darker in coloration than dye coming out of other nozzles. This then will provide a dark streak or a light streak on the carpet because of the improper distribution of coloring particles within the dye liquid.

This problem is overcome by two steps. In the first step a return hose 20 carries dye from the manifold to the dye supply tank 2. Any appropriate means may be used to draw the dye from the manifold 6 back to the supply tank 2. The hose 20 is normally placed at the opposite end of the manifold from which liquid is fed into the manifold. More than one hose 20 could be utilized and it could draw liquid from both ends of the manifold. Normally, about 45 gallons per minute of dye is supplied from the dye supply to the manifold 6. Only 13 gallons a minute of dye are removed from the manifold by the nozzle tubes 8. Consequently, the balance of dye, which is about 32 gallons per minute, must be returned to the supply tank 2 by way of hose 20. If the dye was supplied to the manifold at a rate of 13 gallons a minute, this low flow would permit the coloring particles to separate from the carrier liquid in the dye and the coloring particles could concentrate in certain areas across the manifold. This results in the uneven dyeing across the width of the carpet. By increasing the flows through the manifold we create a turbulent flow conditions within the manifold which help to mix the ink within the manifold to keep coloring particles uniformly dispersed.

To further assist in the distribution of the coloring particles to prevent streaking, there is provided an oscillating bar structure 22 containing fingers 24 which are positioned between the end of the nozzle tubes 8 and the flood plane plate 10. The bar 22 oscillates back and forth across the width of the carpet being dyed and thus the fingers 24 are moved back and forth across the fluid path of the dye moving from the end of the nozzle tubes 8 to the flood plane plate 10. The finger means breaks up the flow of the dye from the nozzle tubes so that the dye falls non-uniformly onto the plate 10. The path of the dye is broken up in part and also in part is caused to move laterally back and forth across the surface of the flood plane plate 10 to a minor degree due to the fingers not only breaking the dye path up, but also forcing it to move slightly in a lateral direction from side to side. This provides for some agitation and distribution of the dye as it is placed upon the flood plane plate 10 and consquently any non-uniform distribution of coloring particles in the dye at that point will tend to be agitated such that the streams of dye coming from the nozzle tubes are more uniformly blended on the flood plane plate 10.

An alternate way to distribute coloring particles to prevent streaking is to oscillate the nozzle board 11 and eliminate the oscillating bar 22 and its fingers 24.

The practice of the above invention over the conventionally defined structure has successfully eliminated dye streaking on carpeting being dyed.

What is claimed is:

1. A method of applying dye to a carpet comprising the steps of:

(a) supplying the dye from a supply tank to a manifold which has its length extending across the full width of the carpet to be dyed, (b) removing the dye from the manifold by passing the dye through a plurality of nozzle tubes positioned along the length of the manifold, (c) flowing the dye from the nozzle tubes onto a flood plane plate positioned above the carpet to be dyed, (d) inclining the flood plane plate means towards the carpet to be dyed and passing the dye from the point where it drops on the flood plane plate means to the edge of the plate means above the carpet with the dye spreading out on the surface of the plate means whereby dye will flow over the total edge of the plate in a waterfall manner, and (e) the improvement comprising:

(1) continuously circulating the dye between the supply tank and the manifold by supplying dye at a rate over three times that needed for the nozzle tubes to create turbulent flow in the manifold and to agitate the dye within the manifold to prevent separation of the dye particles and the dye carrier, and (2) positioning an oscillating bar with plural finger means between the ends of the nozzle tubes and the flood plane plate means whereby the finger means will break up the flow of dye from the nozzle tubes so that the dye falls non-uniformly onto the plate means.

2. The method of applying dye to a carpet as set forth in claim 1 wherein:

(a) the continuous circulation of the dye in the manifold is accomplished by supplying more dye to the manifold than is removed from the manifold by the nozzle tubes, said excess dye in the manifold over that used in the nozzle tubes being circulated back to the supply tank whereby the dual path of dye from the manifold to the nozzle tubes and from the manifold back to the supply tank will agitate the dye.

3. The method of applying dye to a carpet as set forth in claim 1 wherein:

(a) the plural fingers on the oscillating bar move back and forth through the streams of dye from the nozzle tubes and interrupt the linear flow of the dyes streams.

4. A method of applying dye to a carpet comprising the steps of:

(a) supplying the dye from a supply tank to a manifold which has its length extending across the full width of the carpet to be dyed, (b) removing the dye from the manifold by passing the dye through a plurality of nozzle tubes positioned along the length of the manifold, (c) flowing the dye from the nozzle tubes onto a flood plane plate positioned above the carpet to be dyed, (d) inclining the flood plane plate means towards the carpet to be dyed and passing the dye from the point where it drops on the flood plane plate means to the edge of the plate means above the carpet with the dye spreading out on the surface of the plate means whereby dye will flow over the total edge of the plate in a waterfall manner, and (e) the improvement comprising:

(1) continuously circulating the dye between the supply tank and the manifold by supplying dye at a rate over three times that needed for the nozzle tubes to create turbulent flow in the manifold by supplying dye at a rate over three times that needed for the nozzle tubes to create turbulent flow in the manifold and to agitate the dye solution within the manifold, and (2) positioning the nozzle tubes on an oscillating board whereby the nozzle tubes oscillate across the plate means such that the flow of dye from the nozzle tubes randomly falls on the plate means to blend together adjacent dye streams.

5. The method of applying dye to a carpet as set forth in claim 4 wherein:

(a) the continuous circulation of the dye in the manifold is accomplished by supplying more dye to the manifold than is removed from the manifold by the nozzle tubes, said excess dye in the manifold over that used in the nozzle tubes being circulated back to the supply tank whereby the dual path of dye from the manifold to the nozzle tubes and from the manifold back to the supply tank will agitate the dye.

* * * * *